US005304852A

United States Patent [19]

Hiraga et al.

[11] Patent Number: 5,304,852

[45] Date of Patent: Apr. 19, 1994

[54] FLUD DROP DETECTING RESERVOIR TANK

[75] Inventors: Reiji Hiraga, Nirasaki; Yoshihiro Nakamura, Nakakoma, both of Japan

[73] Assignee: Tokico Ltd., Kanagawa, Japan

[21] Appl. No.: 875,806

[22] Filed: Apr. 30, 1992

[30] Foreign Application Priority Data

Apr. 30, 1991 [JP] Japan ..... 3-39695[U]

[51] Int. Cl.[5] ..... H01H 35/18

[52] U.S. Cl. ..... 307/118; 200/84 C; 200/295

[58] Field of Search ..... 307/118; 361/178, 725-727; 200/84 C, 84 R, 81.9 M, 51 R, 43.02, 50 A, 50 R, 293, 295, 296; 116/109, 110; 439/347, 350, 357; 73/DIG. 5, 319; 340/623-624, 450, 450.1, 450.2, 450.3

[56] References Cited

U.S. PATENT DOCUMENTS 3,849,770 11/1974 Hayashida ..... 340/450.1
4,037,193 7/1977 Uemura ..... 200/84 C
4,500,761 2/1985 Kubota et al. ..... 200/84 C
4,681,386 7/1987 Boulanger ..... 439/347
5,083,115 1/1992 Kamiya ..... 73/DIG. 5

*Primary Examiner*—Jeffrey A. Gaffin
*Assistant Examiner*—Richard T. Elms
*Attorney, Agent, or Firm*—Keck, Mahin & Cate

[57] ABSTRACT

A fluid drop detecting reservoir tank has a float with a magnet which moves down in accordance with a drop in the level of fluid in a reservoir tank. The magnet closes a magnetically operated switch when the fluid reaches a predetermined level so that a predetermined drop in the level of the fluid is detected. The fluid drop detecting reservoir tank is provided with a mount casing for receiving therein a switch casing in which the switch is encased. The reservoir tank is provided with a retainer mechanism arranged between the mount casing and the switch casing for holding the switch casing in the mount casing so as to locate the switch below the magnet and preventing the switch casing from being withdrawn from the mount casing.

6 Claims, 6 Drawing Sheets

FLUD DROP DETECTING RESERVOIR TANK

BACKGROUND OF THE INVENTION

1. Field of the Invention

The present invention relates to a fluid reservoir tank for use with brake systems and clutch systems for automotive vehicles and, more particularly, to a fluid drop detecting reservoir tank which can detect a predetermined drop in the level of a fluid in the reservoir tank.

2. Description of Related Art

In order to install reservoir tanks of this kind in restricted spaces and assure certain fluid drop detection, it is typical to use fluid drop detecting means including, in combination, a magnetized float and a reed switch. Some fluid reservoir tanks with such fluid drop detecting means, which are used with, for instance, hydraulic brake systems for automotive vehicles, have magnetized floats disposed in fluid reservoir tanks and reed switch units removably mounted on or attached to the reservoir tanks.

A reservoir tank for use with a hydraulic brake system for an automobile vehicle is described in Japanese Utility Model Publication No. 62-35,635, for example. As shown in FIGS. 1 and 4, in this system, there is provided a float 4 with a magnet 3. The float 4 is movable up and down along a pair of vertical guide rails 2 in a cylindrical fluid container or reservoir tank 1. The reservoir tank 1 is provided, at its bottom, with a mounting casing 5 integrally formed with the reservoir tank 1. A reed switch unit casing 6 is removably inserted into and held in the reservoir tank 1. Within the reed switch unit casing 6, a magnetically operated, normally open reed switch 7 is disposed. The reservoir tank is assembled to a master cylinder 8 of a hydraulic brake system which is well known in the art.

As the volume of brake fluid in the hydraulic cylinder 8 decreases in quantity with the passage of time, hydraulic brake fluid contained in the reservoir tank 1 is supplementarily supplied to the master cylinder 8 so as to maintain a necessary quantity of brake fluid in the master cylinder 8. With a drop of the brake fluid in the reservoir tank 1, the float 4, floating in the brake fluid, slides downward along the guide rails 2. At a predetermined distance from the bottom of the reservoir tank 1, the float 4 places the magnet 3 in such a position that the magnet 3 effectively forces the reed switch 7 to turn on. Turning the reed switch 7 on causes a warning means to provide a warning that the fluid volume in the reservoir tank 1 is low.

Reed switch 7 is generally offset within the reed switch unit casing 6 either in a lengthwise direction or in a transverse direction of the reed switch unit casing 6 with respect to the center of the reed switch unit casing 6. To position the reed switch unit casing 6 at a predetermined position with respect to the magnet 3, the reed switch unit casing 6 should be positioned at a predetermined position in the mount casing 5 with respect to the reservoir tank 1. For this reason, the mount casing 5 is formed with a guide groove 9 extending in a direction in which the reed switch unit casing 6 is inserted. In addition, for preventing the reed switch unit casing 6 from coming out of the mount casing 5, the reed switch unit casing 6 is provided, at its forward end as viewed in a direction of insertion, with a stopper means, such as an elastically contractible projection 11. The elastically contractible projection 11 is contracted so as to pass through the guide groove 9 to an end opening 10 formed at the rear end of the mount casing 5. The reed switch unit casing 6 is forced into the mount casing 5, and the projection 11 elastically expands and is returned to its original shape in the end opening 10. The reed switch unit casing, therefore, firmly engages with and is retained by the rear end of the mount casing 5 when the reed switch unit casing 6 is properly positioned within the mount casing 5.

Because the elastically contractible projection requires a great thrust force in order to be contracted, the elastically contractible projection makes it difficult to demount the reed switch unit casing 6, which firmly engages with and is retained by the rear end of the mount casing 5, from the mount casing 5. In addition, because the elastically contractible projection is provided at the forward end, in a direction of insertion, of the reed switch unit casing 6, it is forced to strongly rub against the guide groove while the reed switch unit casing 6 is mounted and demounted. The projection, consequently, may be broken.

SUMMARY OF THE INVENTION

It is, therefore, an object of the present invention to provide a fluid drop detecting reservoir in which a reed switch unit casing can be easily mounted and demounted without breaking a stopper means.

This object is achieved by providing a particularly constructed fluid drop detecting reservoir tank. The tank has a float with a permanent magnet which is guided so as to move down with a drop in the level of fluid in the reservoir tank. Such a drop causes magnetically operated switch means, such as a normally open reed switch disposed below a bottom wall of the reservoir tank, to close when the fluid within the reservoir tank reaches a predetermined level. As a result, a predetermined drop of the fluid is detected, thereby warning of a fluid volume drop. A switch casing, having the magnetically operated switch means encased therein, is capable of being inserted into and withdrawn from a generally parallelepiped mount casing formed integrally with the bottom wall of the reservoir tank and shaped complementarily to the switch casing. Between the switch casing and the generally parallelepiped mount casing, there is provided a retainer means for holding the switch casing in the generally parallelepiped mount casing so as to locate the magnetically operated switch means below the magnet and prevent it from being withdrawn from the generally parallelepiped mount casing. The retainer means includes a quadrangular opening formed in a bottom wall of the generally parallelepiped mount casing, a retainer formed integrally with the bottom wall of the generally parallelepiped mount casing so as to extend into the quadrangular opening and able to elastically deform so as to change between positions within and out of the quadrangular opening, and a stopper projection integrally formed with and extending downward from the switch casing. As the switch casing is inserted into the generally parallelepiped mount casing, the retainer is initially engaged and elastically deformed by the stopper projection so as to be displaced out of the quadrangular opening. The retainer is then disengaged from the stopper projection so as to be reinserted into the quadrangular opening. As a result, the retainer is made engageable with the stopper projection within the quadrangular opening in a direction in which the switch casing is withdrawn from the generally parallelepiped mount casing.

In a specific embodiment of the present invention, the stopper projection is shaped as an orthogonal triangle so as to have a front end surface almost perpendicular to a lower surface of the bottom wall of the switch casing and a lower oblique surface sloped upward from the front end. The retainer includes an elastically bendable arm portion, extending rearward from a front end of the bottom wall into the quadrangular opening. The elastically bendable arm portion includes an upper surface sloped downwardly and forward from an upper surface of the bottom wall of the generally parallelepiped mount casing and a rear end surface almost perpendicular to the upper surface. The retainer also includes a stem portion, extending downward from the retainer arm portion. When the stem portion is pulled forward, the elastically bendable arm portion is elastically bendable downward along its front end. The retainer means may further include a strip-shaped front end collar extending downward from a front end of the switch casing so as to define a space between a rear surface of the front end collar and the front end surface of the orthogonal triangular projection. The stopper projection is located at a distance from the front end collar so as to define therebetween a space for receiving the arm portion therein. The space has a length, in a lengthwise direction in which the switch casing is inserted into the generally parallelepiped mount casing, which is slightly longer than a length of the retainer arm portion.

BRIEF DESCRIPTION OF THE DRAWINGS

The above and other objects and features of the present invention will be apparent to those skilled in the art from the following description, which is directed to a preferred embodiment thereof, when considered in conjunction with the appended drawings. In the drawings:

FIGS. 11A–11C are each longitudinal cross-sectional views taken along line 11—11 of FIG. 6 wherein;

FIG. 11A is a longitudinal cross-sectional view of FIG. 6 as seen along line 11—11;

FIG. 11B is a longitudinal cross-sectional view, similar to FIG. 11A, in which a demounting lever is deformed and turned to demount the reed switch unit casing; and FIG. 11C is a longitudinal cross-sectional view, similar to FIG. 11A, in which the reed switch unit casing is being demounted.

DETAILED DESCRIPTION OF THE PREFERRED EMBODIMENT

Figure 1:
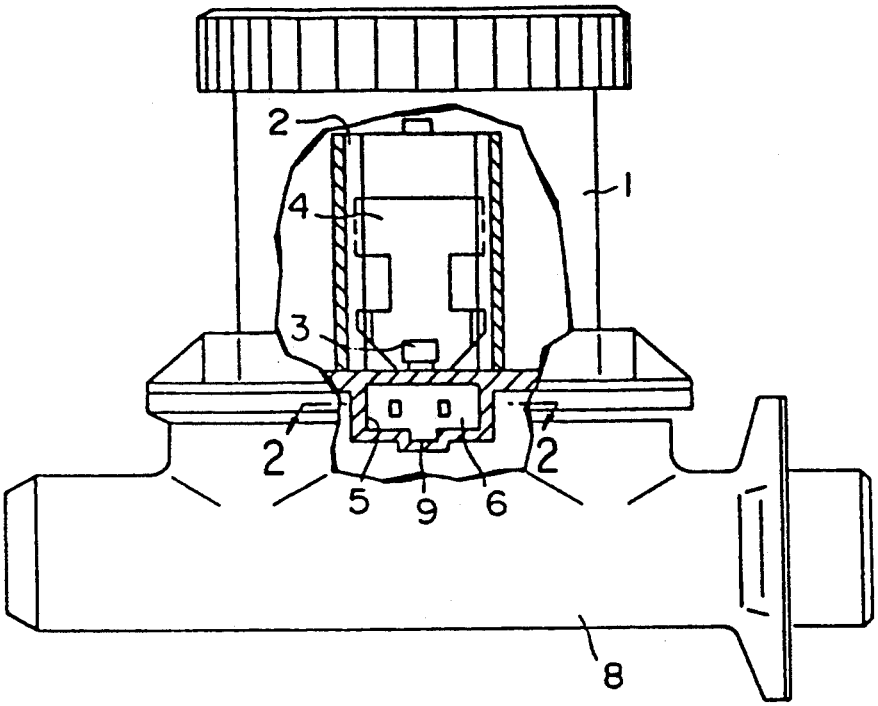
FIG 1 PRIOR ART
FIG. 1, as noted above, is a front view, partly broken away, of a prior art fluid drop detecting reservoir tank.
Figure 2:
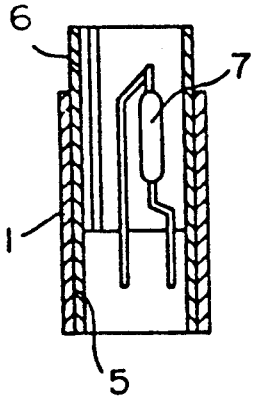
FIG 2 PRIOR ART
FIG. 2 is a longitudinal and sectional view of the tank shown in FIG. 1 as seen along line 2—2.
Figure 3:
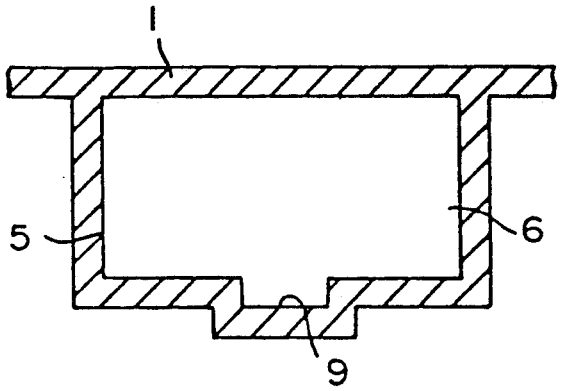
FIG 3 PRIOR ART
FIG. 3 is a cross-sectional view of a mount casing of the reservoir tank shown in FIG. 1 in which a reed switch unit casing is demounted.
Figure 4:
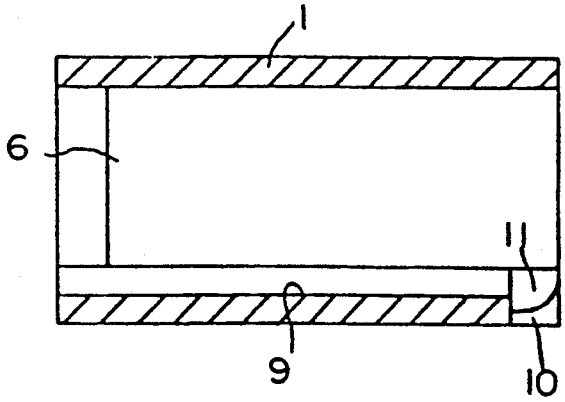
FIG 4 PRIOR ART
FIG. 4 is a longitudinal cross-sectional view of the mount casing shown in FIG. 3 in which a reed switch unit casing is mounted.
Figure 5:
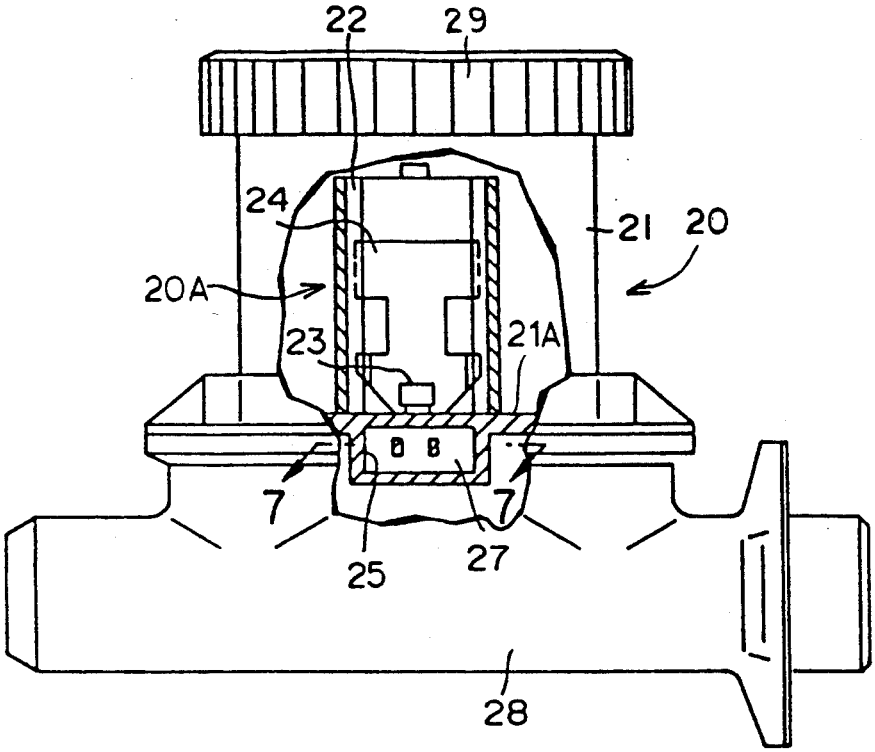
FIG. 5 is a front view, partly broken out, of a fluid drop detecting reservoir tank in accordance with a preferred embodiment of the present invention.
Figure 7:
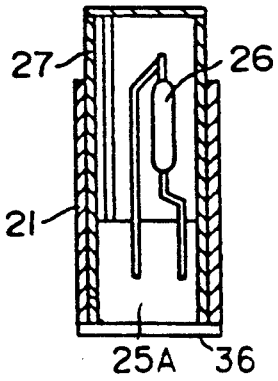
FIG. 7 is a longitudinal cross-sectional view as seen along line 7—7 of FIG. 5.
Figure 6:
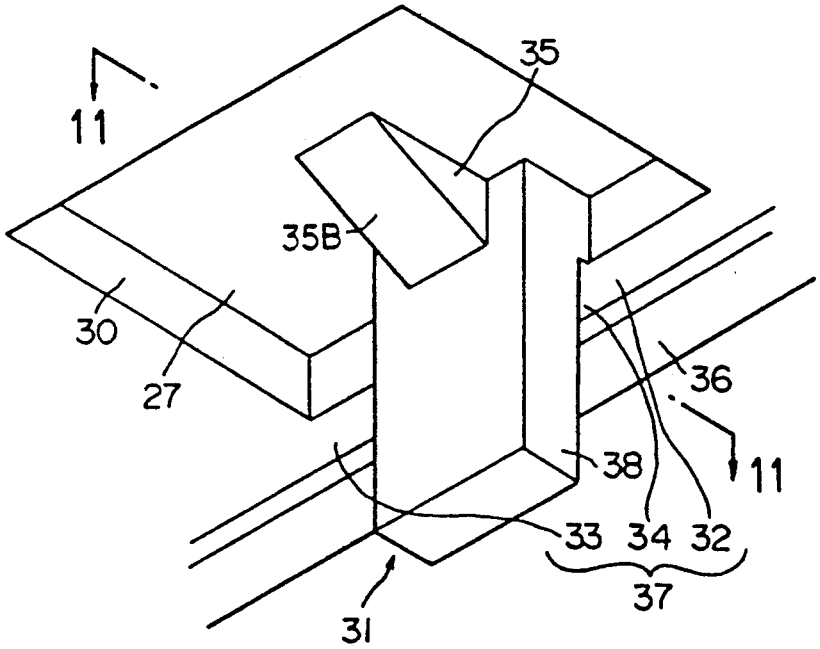
FIG. 6 is a perspective bottom view showing part of the reservoir tank shown in FIG. 5 in which a reed switch unit casing is mounted.
Figure 8:
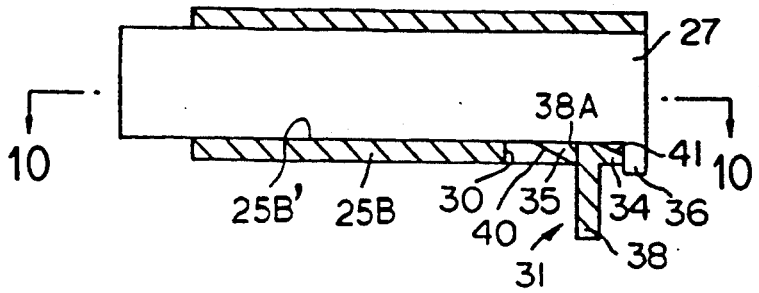
FIG. 8 is a longitudinal cross-sectional view of a reed switch unit casing of the reservoir tank shown in FIG. 5.
Figure 9:
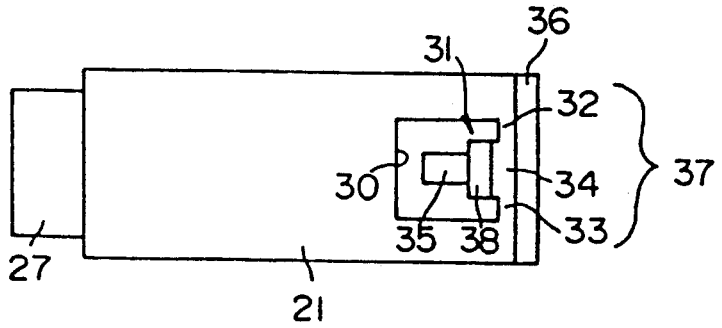
FIG. 9 is a bottom view of the casing of FIG. 8.

Parts which are not of direct importance to the invention and parts which are purely of conventional construction will not be shown or described in detail.

Because hydraulic brake systems including master cylinders are well known, the present description will be particularly directed to elements forming part of, or cooperating directly with, a reservoir tank in accordance with the present invention. It is to be understood that elements not specifically shown or described can take various forms well known to those skilled in the hydraulic brake system art.

Referring to the drawings in detail and, in particular, to FIGS. 5 to 10 and 11A to 11C, a fluid drop detecting reservoir tank 20 (hereafter referred to as a "reservoir tank" for simplicity), in accordance with a preferred embodiment of the present invention, is shown. The reservoir tank 20 is assembled to a master cylinder 28 of a hydraulic brake system, which itself is well known in the art. The reservoir tank 20 has an open-ended cylindrical tank 21, which is desirably made of synthetic resins or plastics, and a lid 29. Within the tank 21, there is provided a fluid drop detecting means 20A for detecting a drop in the level of a fluid, such as a brake oil, in the tank 21. The fluid drop detecting means 20A is formed by a generally rectangularly-shaped float 24 with a permanent magnet 23 secured to a lower end thereof which is able to float in the fluid, and a magnetically operated reed switch 26 which will be described later in conjunction with FIG. 7. The tank 21 is provided with a pair of guide columns 22 extending upright and parallel to each other from a bottom wall 21A of the tank 21, for guiding the float as it undergoes up and down movement. Between the guide columns 22, the float 24 smoothly slides down as the level of the fluid drops.

Outside the tank 21, there is provided a generally parallelepiped mount casing 25, integrally formed with or otherwise secured to the bottom wall 21A. In the mount casing 25, a rectangularly box-shaped or parallelepiped space 25A, extending longitudinally in a direction perpendicular to the upright guide columns 22, is defined so as to mount and position the magnetically operated reed switch 26 directly below the float 24.

Rectangularly box-shaped or reed switch unit casing 27, which is supplementary in shape to the rectangularly box-shaped or parallelepiped space 25A, has the magnetically operated reed switch 26 encased therein. More specifically, the reed switch 26 is fixedly positioned so that it is offset rearward in the lengthwise direction with respect to the reed switch unit casing 27. When the reed switch unit casing 27 is properly mounted in the mount casing 25, the reed switch 26 is positioned right below the magnet 23 of the float 24 so as to be turned on or closed by the magnet 23 when the fluid reaches a predetermined level and the float 24 correspondingly. If necessary, the reed switch unit casing 27 can be demounted from the mount casing 25.

As shown in FIGS. 6 and 8 to 10, to properly mount and easily demount the reed switch unit casing 27 from the mount casing 25, there is formed a generally U-shaped or quadrangular holding opening 30 formed in a bottom wall 25B of the mount casing 25 and a generally upside-down L-shaped, elastically deformable or bendable lever means 31, extending downward from the front end of the holding opening 30. The holding opening 30 is located close to the forward end of the mount casing 27. The generally L-shaped lever means 31 is formed by an arm portion 34, extending backward from the front end of the bottom wall 25B, and a stem portion 38, extending downward from the arm portion 34. The arm portion 34 is integrally formed with front end portions 32 and 33 of the bottom wall 25B so as to form a strip-shaped front end portion 37 of the bottom wall 25B. The arm portion 34 also has an upper surface 41 sloped upward from its front end to its rear end as viewed from the side (see FIG. 8). Providing the arm portion 34 of the lever means 31 with the sloped upper surface 41 permits the lever means 31 to elastically bend upward and downward easily at its foremost end. The stem portion 38 is integrally formed with the arm portion 34 and has a back surface 38A perpendicular to the upper surface 25B' of the bottom wall 25B. On the other hand, the reed switch unit casing 27 is integrally formed with a strip-shaped front end collar 36, having a back surface 36A extending downward from its front end portion and an orthogonal triangular stopper projection 35 extending downward therefrom. The orthogonal triangular stopper projection 35 has a front surface 35A which extends downward from and perpendicularly to the under surface of the reed switch unit casing 27 and an oblique surface 35B sloped upward from its front end to its rear end as viewed from the side (see FIG. 6). The stopper projection 35 is located so as to form a space 42 under the reed switch unit casing 27 between the back surface 36A of the front end collar 36 and the front surface 35A of the stopper projection 35. The space 42 has a length, in a lengthwise direction in which the reed switch unit casing 27 is inserted into the mount casing 25, which is slightly longer than a length of the arm portion 34 of the lever means 31.

Figure 10:
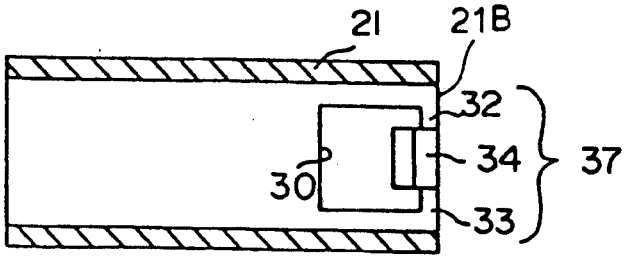
FIG. 10 is a longitudinal cross-sectional view of FIG. 8 as seen along line 10—10.
Figure 11A:
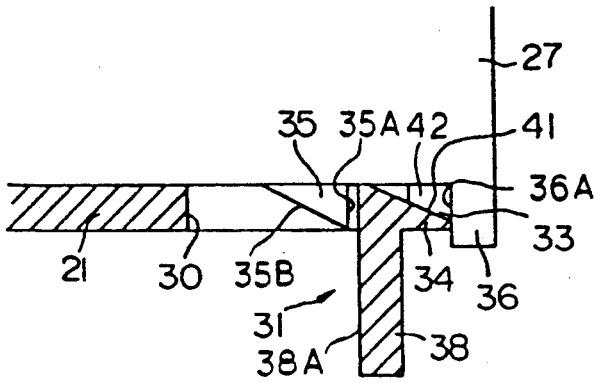
Figure 11B:
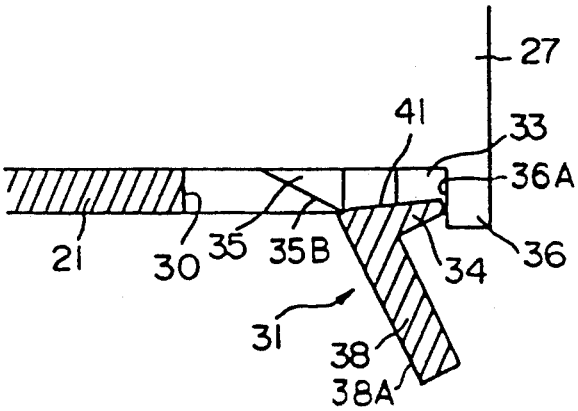
Figure 11C:
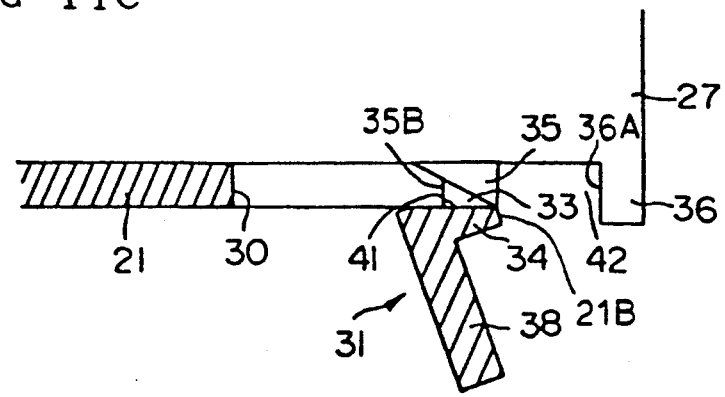

In the fluid drop detecting reservoir tank 20 structured in this way, when the reed switch unit casing 27 is assembled to the reservoir tank 21, the reed switch unit casing 27 is initially inserted into the mount casing 25 until the sloped lower surface 35B of the stopper projection 35 of the reed switch unit casing 27 abuts against the front edge 21B of the bottom wall 21A (see FIG. 10). Then, when the reed switch unit casing 27 is continuously forced into the mount casing 25, the stopper projection 35 forces the lever means 31 to deform downward so as to ride over and slide on the sloped upper surface 41 of the arm portion 34 of the lever means 31, as is shown in FIG. 11C. When the reed switch unit casing 27 is inserted into the mount casing 25, deforming the lever means 31 until the front end collar 36 of the reed switch unit casing 27 abuts against the front edge 21B of the bottom wall 21A, the stopper projection 35 rides over the sloped upper surface 41 of the arm portion 34 of the lever means 31. As a result, the lever means 31 is restored to its original position so as to bring the arm portion 34 into the space 42 with a slight clearance behind the arm portion 34, as shown in FIG. 11A. In this manner, the reed switch unit casing 27 is properly mounted and assembled in the mount casing 25 (see FIG. 6) so as to fixedly locate the reed switch 26 below the float 24 and, in particular, the permanent magnet 23 within the tank 21.

If a demand for removing or disassembling the reed switch unit casing 27 from the reservoir tank 20 arises for the purpose of, for instance, replacing the casing with another, the lever means 31 is deformed and the reed switch unit casing 27 is pulled forward. Specifically, for deforming the lever means 31 from its original position, shown in FIG. 11A, the stem portion 38 of the lever means 31 is pushed forward from the back or turned in the counterclockwise direction as viewed in FIG. 11B so as to bend the arm portion 34 along its front edge. During bending of the arm portion 34, the arm portion 34, on one hand, elastically deforms the stopper projection 35 and the front end collar 36 of the reed switch unit casing 27 to expand the space 42 slightly in the lengthwise direction and, on the other hand, elastically contacts itself slightly in the lengthwise direction. When the arm portion 34 of the lever means 31 is turned sufficiently to escape, at its rear edge, from the lower edge of the front surface 35A of the stopper projection 35 of the reed switch unit casing 27, the stopper projection 35 and the front end collar 36 of the reed switch unit casing 27 are elastically restored, so that the stopper projection 35 of the reed switch unit casing 27 rides on the sloped upper surface 41 of the arm portion 34 of the lever means 31, as shown in FIG. 11B. In order to assure that the stopper projection 35 rides on the sloped upper surface 41 of the arm portion 34, it is helpful to push the reed switch unit casing 27 forward from its rear end. After the stopper projection 35 has ridden on the sloped upper surface 41 of the arm portion 34, the reed switch unit casing 27 can be pulled out of the mount casing 25. As the reed switch unit casing 27 is pulled forward, the stopper projection 35 of the reed switch unit casing 27 slides on the sloped upper surface 41 of the arm portion 34 of the lever means 31 (see FIG. 11C). When the reed switch unit casing 27 is pulled forward sufficiently to disengage the stopper projection 35 from the arm portion 34 of the lever means 31, the lever means 31 is restored to its original position. Then, as the reed switch unit casing 27 is continuously pulled out from the mount casing 25, it becomes easy to remove the reed switch unit casing 27 from the mount casing of the reservoir tank 20. Consequently, it is easy to disassemble the casing 27 from the reservoir tank 20. Because the lever means 31 is in its original position when the reed switch unit casing 27 is disassembled from the reservoir tank 20, the reservoir tank 20 is made ready to receive another reed switch unit casing.

What is claimed is:

1. A fluid drop detecting reservoir tank having a float with a magnet which is guided so as to move down together with a drop in a level of a fluid in a reservoir tank, said magnet causing a magnetically operated switch means, disposed below a bottom wall of said reservoir tank, to close when said fluid in the reservoir tank reaches a predetermined level so as to detect a predetermined volume drop of the fluid, said fluid drop detecting reservoir tank comprising:

a generally parallelepiped mount casing formed integrally with said bottom wall of said reservoir tank;

a switch casing shaped complementarily to said generally parallelepiped mount casing and having said magnetically operated switch means encased therein, said switch casing being capable of being inserted into and withdrawn from said generally parallelepiped mount casing; and retainer means for holding said switch casing in said generally parallelepiped mount casing so as to prevent said switch casing from being withdrawn from said generally parallelepiped mount casing, said retainer means comprising a quadrangular opening formed in a bottom wall of said generally parallelepiped mount casing, a retainer, extending in a direction in which said switch casing is inserted into said generally parallelepiped mount casing, said retainer extending within said quadrangular opening and from said bottom wall of said generally parallelepiped mount casing and being elastically changeable between positions within and out of said quadrangular opening, and a stopper projection integrally formed with and extending downward from said generally parallelepiped switch casing, said retainer being initially engaged and forced by said stopper projection so as to be displaced out of said quadrangular opening and then disengaged from said stopper projection so as to return into said quadrangular opening as said switch casing is inserted into said generally parallelepiped mount casing, said retainer thereby being engageable with said stopper projection within said quadrangular opening in a direction in which said switch casing is withdrawn from said generally parallelepiped mount casing.

2. A fluid drop detecting reservoir tank having a float with a magnet which is guided so as to move down together with a drop in a level of a fluid in a reservoir tank, said magnet causing a magnetically operated switch means, disposed below a bottom wall of said reservoir tank, to close when said fluid in the reservoir tank reaches a predetermined level so as to detect a predetermined volume drop of the fluid, said fluid drop detecting reservoir tank comprising:

a generally parallelepiped mount casing formed integrally with said bottom wall of said reservoir tank;

a switch casing shaped complementarily to said generally parallelepiped mount casing and having said magnetically operated switch means encased therein, said switch casing being capable of being inserted into and withdrawn from said generally parallelepiped mount casing; and retainer means for holding said switch casing in said generally parallelepiped mount casing so as to prevent said switch casing from being withdrawn from said generally parallelepiped mount casing, said retainer means comprising a quadrangular opening formed in a bottom wall of said generally parallelepiped mount casing, a retainer, formed integrally with said bottom wall of said generally parallelepiped mount casing so as to extend into said quadrangular opening, said retainer being able to elastically deform so as to change between positions within and out of said quadrangular opening, and a stopper projection integrally formed with and extending downward from said parallelepiped switch casing, said retainer being initially engaged and elastically deformed by said stopper projection so as to be displaced out of said quadrangular opening and then disengaged from said stopper projection so as to be restored into said quadrangular opening as said switch casing is inserted into said generally parallelepiped mount casing, thereby being engageable with said stopper projection within said quadrangular opening in a direction in which said switch casing is withdrawn from said generally parallelepiped mount casing.

3. A fluid drop detecting reservoir tank as recited in claim 2, wherein said retainer comprises a retainer arm portion, extending rearward from a front end of said bottom wall into said quadrangular opening and having an upper surface sloped down and forwardly from an upper surface of said bottom wall of said generally parallelepiped mount casing and a rear end surface almost perpendicular to said upper surface, and a retainer stem portion, extending downward from said retainer arm portion, said retainer arm portion being elastically bendable downward along its front end when said retainer stem portion is pulled forward.

4. A fluid drop detecting reservoir tank as recited in claim 3, wherein said stopper projection comprises an orthogonal triangular projection having a front end surface almost perpendicular to an lower surface of said bottom wall and an oblique surface sloped upward from said front end.

5. A fluid drop detecting reservoir tank as recited in claim 4, wherein said retainer means further comprises a strip-shaped front end collar extending downward from a front end of said switch casing so as to define a space between a rear surface of said front end collar and said front end surface of said orthogonal triangular projection, said space having a length, in a lengthwise direction in which said switch casing is inserted into said generally parallelepiped mount casing, slightly longer than a length of said retainer arm portion.

6. A fluid drop detecting reservoir tank as recited in claim 2, wherein said magnetically operated switch means comprises a normally open reed switch.

* * * * *